US011098263B2

(12) United States Patent
Yamamoto et al.

(10) Patent No.: US 11,098,263 B2
(45) Date of Patent: Aug. 24, 2021

(54) LUBRICATING OIL COMPOSITION FOR SLIDING GUIDE SURFACE

(71) Applicant: Cosmo Oil Lubricants Co., Ltd., Tokyo (JP)

(72) Inventors: Kuniharu Yamamoto, Tokyo (JP); Masaaki Kondo, Saitama (JP); Kenichi Sekine, Saitama (JP)

(73) Assignee: Cosmo Oil Lubricants Co., Ltd., Tokyo (JP)

( * ) Notice: Subject to any disclaimer, the term of this patent is extended or adjusted under 35 U.S.C. 154(b) by 0 days.

(21) Appl. No.: 16/336,258

(22) PCT Filed: Sep. 25, 2017

(86) PCT No.: PCT/JP2017/034534
§ 371 (c)(1),
(2) Date: Mar. 25, 2019

(87) PCT Pub. No.: WO2018/062100
PCT Pub. Date: Apr. 5, 2018

(65) Prior Publication Data

US 2019/0300816 A1 Oct. 3, 2019

(30) Foreign Application Priority Data

Sep. 28, 2016 (JP) ..... JP2016-189965
Nov. 14, 2016 (JP) ..... JP2016-221262

(51) Int. Cl.
*C10M 169/04* (2006.01)
*C10M 133/06* (2006.01)
(Continued)

(52) U.S. Cl.
CPC ..... *C10M 169/04* (2013.01); *C10M 133/04* (2013.01); *C10M 133/06* (2013.01);
(Continued)

(58) Field of Classification Search
CPC ..... C10M 169/04; C10M 135/00; C10M 133/04; C10M 141/10; C10M 137/04;
(Continued)

(56) References Cited

U.S. PATENT DOCUMENTS

2011/0021394 A1 1/2011 Nakao et al.
2014/0249060 A1* 9/2014 Nakao ..... C10M 169/04 508/420

FOREIGN PATENT DOCUMENTS

EP 711822 A2 5/1996
JP H08-134488 A 5/1996
(Continued)

*Primary Examiner* — Taiwo Oladapo
(74) *Attorney, Agent, or Firm* — Banner & Witcoff, Ltd.

(57) ABSTRACT

A lubricating oil composition for a sliding guide surface, which includes a lubricant base oil, an acid phosphate ester mixture having a structure represented by the following Formula (1) and including an acid phosphate monoester and an acid phosphate diester, and an aliphatic monoamine, and which satisfies a predetermined condition A or condition B, is provided. In Formula (1), each of $R^1$ and $R^2$ represents a hydrogen atom or a saturated or unsaturated straight-chain aliphatic hydrocarbon group having from 1 to 30 carbon atoms, and $R^1$ and $R^2$ are not simultaneously hydrogen atoms.

$$(R^1O)(R^2O)(HO)P{=}O \quad (1)$$

3 Claims, 1 Drawing Sheet

(51) Int. Cl.

| | |
|---|---|
| ***C10M 135/08*** | (2006.01) |
| ***C10M 135/22*** | (2006.01) |
| ***C10M 137/04*** | (2006.01) |
| ***C10M 141/10*** | (2006.01) |
| ***C10M 133/04*** | (2006.01) |
| ***C10M 135/00*** | (2006.01) |

(52) U.S. Cl.
CPC ..... *C10M 135/00* (2013.01); *C10M 135/08* (2013.01); *C10M 135/22* (2013.01); *C10M 137/04* (2013.01); *C10M 141/10* (2013.01); *C10M 2203/1025* (2013.01); *C10M 2215/26* (2013.01); *C10M 2219/042* (2013.01); *C10M 2219/082* (2013.01); *C10M 2223/04* (2013.01)

(58) Field of Classification Search
CPC ..... C10M 135/22; C10M 135/08; C10M 133/06; C10M 2223/04; C10M 2219/082; C10M 2219/042; C10M 2215/26; C10M 2203/1025; C10M 137/08; C10M 2203/1006; C10M 2215/04; C10M 2223/043; C10N 2220/022; C10N 2220/028; C10N 2220/027; C10N 2230/06; C10N 2240/06
See application file for complete search history.

(56) References Cited

FOREIGN PATENT DOCUMENTS

| | | | | |
|---|---|---|---|---|
| JP | 2007-238764 | A | | 9/2007 |
| JP | 2007238764 | A | * | 9/2007 |
| JP | 2009-235266 | A | | 10/2009 |
| JP | 2011-68801 | A | | 4/2011 |
| JP | 2012-240137 | A | | 12/2012 |
| WO | 2009119332 | A1 | | 10/2009 |

* cited by examiner

LUBRICATING OIL COMPOSITION FOR SLIDING GUIDE SURFACE

RELATED APPLICATION

This application is a national stage entry of PCT/JP2017/034534, filed Sep. 25, 2017 which claims foreign priority of Japanese Patent Application No. 2016-221262, filed Nov. 14, 2016, and of Japanese Patent Application No. 2016-189965, filed Sep. 28, 2016, which are incorporated by reference in their entirety.

TECHNICAL FIELD

The present disclosure relates to a lubricating oil composition for a sliding guide surface.

BACKGROUND ART

Machine tools, which are machines for cutting work or grinding work of metals, often adopt sliding guide surfaces (i.e., sliding surfaces) as guide surfaces in machine structures. The sliding guide surfaces have high friction coefficients due to surface contact and are prone to result in stick slip particularly at low speeds, and there is concern about the influence of such stick slip on working accuracy and tool life. Therefore, lubricating oils for sliding guide surfaces of machine tools (also referred to as "sliding surface oils") are required to have sufficiently low friction coefficients, favorable stick-slip inhibition properties (i.e., favorable friction characteristics), favorable metal corrosion prevention properties, and favorable storage stability.

A lubricating oil composition formed by allowing a lubricant base oil to contain an acid phosphate ester having a particular structure and an amine compound having a particular structure in predetermined amounts has been proposed (see, for example, Japanese Patent Application Laid-Open (JP-A) No. 2009-235266 and JP-A No. 2011-68801) as a lubricating oil for a sliding guide surface of a machine tool, formed by focusing on such characteristics described above.

The working accuracy of machine tools has been commonly known to be influenced by the heat deformation of such tools, caused by a variation between inside and outside temperatures. Therefore, measures in view of hardware and software, such as in-situ measures of the placement of machine tools in thermostatic chambers, the performance of finishing steps as separate steps, and the like, measures against the heat deformation of the machine tools themselves, and technologies for correcting the displacement of the machine tools, have been taken in order to achieve high working accuracy (see, for example, JP-A No. 2012-240137).

SUMMARY OF INVENTION

Technical Problem

In such measures in view of hardware and software as described in JP-A No. 2012-240137, the influence of a variation in the humidity of a working environment on sliding guide surface oil has been rarely examined although measures against heat displacement caused by a variation in the temperature of the working environment have been taken as described above.

However, examination performed by the present inventors confirmed that the friction coefficient of a sliding guide surface in a high-humidity environment is higher than that in a low-humidity environment, and that the high-humidity environment may influence working accuracy.

Lubricating oil compositions described in JP-A No. 2009-235266 and JP-A No. 2011-68801 are formed without focusing on friction characteristics under high humidity.

An object of one embodiment of the present invention is to provide a lubricating oil composition for a sliding guide surface, exhibiting excellent friction characteristics under both low humidity and high humidity.

Solution to Problem

The present inventors found that a lubricating oil composition that can express, even under high humidity, a favorable friction characteristic exhibited under low humidity is formed by blending a lubricant base oil with a certain amount of mixture of an acid phosphate monoester and an acid phosphate diester having a particular structure, and with a certain amount of branched-chain aliphatic monoamine, and by allowing a molar ratio in such blending to be in a particular range.

The invention includes the following aspects.

<1> A lubricating oil composition for a sliding guide surface, including: a lubricant base oil; an acid phosphate ester mixture having a structure represented by the following Formula (1) and including an acid phosphate monoester and an acid phosphate diester; and an aliphatic monoamine, the lubricating oil composition satisfying the following condition A or condition B:

condition A: a content of the acid phosphate ester mixture is from 0.12 to 0.5% by mass based on the total amount of the composition, the aliphatic monoamine is a branched-chain aliphatic monoamine, the content of the branched-chain aliphatic monoamine is from 0.015 to 0.09% by mass based on a total amount of the composition, and a molar ratio (AB) between the acid phosphate ester mixture (A) and the branched-chain aliphatic monoamine (B) in the composition is from 1.0 to 6.5; or condition B: a content of the acid phosphate ester mixture is from 0.12 to 0.6% by mass based on a total amount of the composition, the aliphatic monoamine is a straight-chain aliphatic monoamine, and the content of the straight-chain aliphatic monoamine is from 0.12 to 0.4% by mass based on a total amount of the composition.

$$(R^1O)(R^2O)(HO)P{=}O \quad (1)$$

In Formula (1), each of $R^1$ and $R^2$ represents a hydrogen atom or a saturated or unsaturated straight-chain aliphatic hydrocarbon group having from 1 to 30 carbon atoms, and $R^1$ and $R^2$ are not simultaneously hydrogen atoms.

<2> The lubricating oil composition for a sliding guide surface according to <1>, wherein the condition A is satisfied.

<3> The lubricating oil composition for a sliding guide surface according to <1>, wherein the condition B is satisfied.

<4> The lubricating oil composition for a sliding guide surface according to any one of <1> to <3>, further including from 0.1 to 15% by mass of a sulfur compound based on a total amount of the composition.

Advantageous Effects of Invention

According to one embodiment of the invention, a lubricating oil composition for a sliding guide surface, exhibiting excellent friction characteristics under both low humidity and high humidity, can be provided.

DESCRIPTION OF EMBODIMENTS

Figure 1:
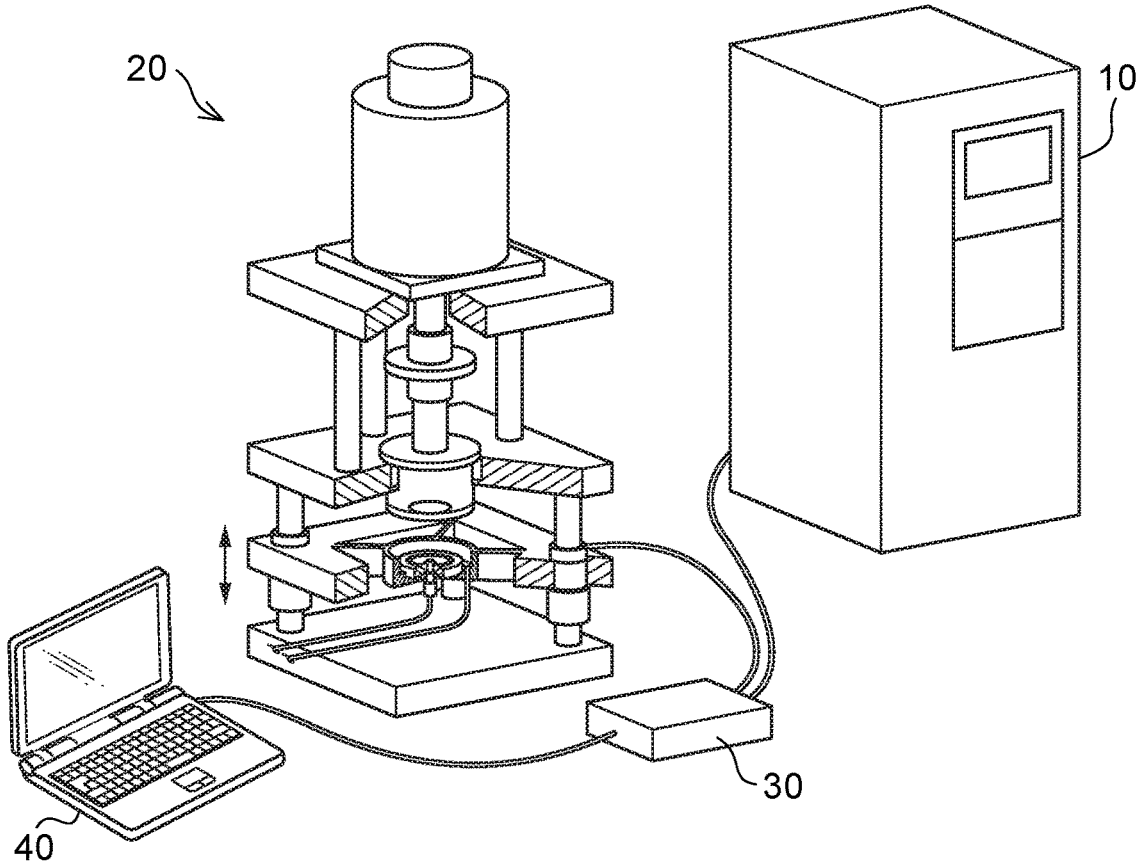
FIG. 1 is a schematic view illustrating the configuration of a machine and system for testing a friction coefficient used in Examples.

A lubricating oil composition for a sliding guide surface of the present disclosure will be described in detail below.

Herein, any numerical range expressed using "to" refers to a range including the numerical values before and after "to" as the upper and lower limit values, respectively. Further, a case in which a unit is stated only for the maximum value in a numerical range expressed using "to" means that the minimum value is also expressed in the same unit.

With respect to numerical ranges stated hierarchically herein, the upper or lower limit value of a certain numerical range of a hierarchical level may be replaced with the upper or lower limit value of a numerical range of another hierarchical level. Further, an upper or lower limit value stated for a certain numerical range in a numerical range stated herein may be replaced with a value set forth in any of the Examples.

Herein, in a case in which plural kinds of substances corresponding to a respective component exist in the composition, the amount of the respective component in the composition means, unless otherwise specified, the total amount of the plural kinds of substances existing in the composition.

Herein, a combination of preferred aspects is a more preferred aspect.

Herein, "high humidity" means 75% RH or more at 25° C. while "low humidity" means 30% RH or less at 25° C.

The lubricating oil composition for a sliding guide surface according to an embodiment of the present disclosure (hereinafter, also simply referred to as "lubricating oil composition") is a lubricating oil composition that includes a lubricant base oil, an acid phosphate ester mixture having a structure represented by the following Formula (1) and including an acid phosphate monoester and an acid phosphate diester, and an aliphatic monoamine, and that satisfies the following condition A or B.

Condition A:

The content of the acid phosphate ester mixture is from 0.12 to 0.5% by mass based on a total amount of the composition, the aliphatic monoamine is a branched-chain aliphatic monoamine, the content of the branched-chain aliphatic monoamine is from 0.015 to 0.09% by mass based on a total amount of the composition, and a molar ratio (A/B) between the phosphate ester mixture (A) and the branched-chain aliphatic monoamine (B) in the composition is from 1.0 to 6.5.

Condition B:

The content of the acid phosphate ester mixture is from 0.12 to 0.6% by mass based on a total amount of the composition, the aliphatic monoamine is a straight-chain aliphatic monoamine, and the content of the straight-chain aliphatic monoamine is from 0.12 to 0.4% by mass based on a total amount of the composition.

Hereinafter, an explanation in which the lubricating oil composition according to an aspect satisfying the condition A is referred to as "lubricating oil composition A", if appropriate, and the lubricating oil composition according to an aspect satisfying the condition B is referred to as "lubricating oil composition B", if appropriate, is offered.

The mixture of an acid phosphate monoester and an acid phosphate diester, having a structure represented by the following Formula (1), may be referred to as "component (A)" or "acid phosphate ester mixture", if appropriate.

The branched-chain aliphatic monoamine may be referred to as "component (B1)", and the straight-chain aliphatic monoamine may be referred to as "component (B2)".

The lubricating oil composition A includes a lubricant base oil, the mixture (component (A)) of an acid phosphate monoester and an acid phosphate diester, having a structure represented by the following Formula (1), of which the content is from 0.12 to 0.5% by mass based on a total amount of the composition, and the branched-chain aliphatic monoamine (component (B1)), of which the content is from 0.015 to 0.09% by mass based on a total amount of the composition. A molar ratio (A/B1) between the phosphate ester mixture (A) and the branched-chain aliphatic monoamine (B1) in the composition is from 1.0 to 6.5.

The lubricating oil composition B includes a lubricant base oil, the mixture (component (A)) of an acid phosphate monoester and an acid phosphate diester, having a structure represented by the following Formula (1), of which the content is from 0.12 to 0.6% by mass based on a total amount of the composition, and the straight-chain aliphatic monoamine (component (B2)) of which the content is from 0.12 to 0.4% by mass.

$$(R^1O)(R^2O)(HO)P{=}O \quad (1)$$

In Formula (1), each of $R^1$ and $R^2$ represents a hydrogen atom or a saturated or unsaturated straight-chain aliphatic hydrocarbon group having from 1 to 30 carbon atoms, and $R^1$ and $R^2$ are not simultaneously hydrogen atoms.

Blending of a certain amount of mixture (component (A)) of the acid phosphate esters having the particular structure and a certain amount of branched-chain aliphatic monoamine (component (B1)) allows the lubricating oil composition A to exhibit excellent friction characteristics even under both low humidity and high humidity. Therefore, the lubricating oil composition A enables the provision of a lubricating oil for a sliding guide surface that can be used without deterioration of friction characteristics not only under low humidity but also under high humidity (for example, in the rainy season, the summer season, or the like).

The mechanism of the action by which the lubricating oil composition A exhibits such an effect is not clear but is presumed to be as follows. However, the following presumption does not provide a limited interpretation of the effect of the lubricating oil composition A but instead provides an explanation of the effect as an example.

That is to say, the mixture (component (A)) of the monoester and diester of the acid phosphate esters included in the lubricating oil composition A tends to reduce the effect of decreasing a friction coefficient under high humidity while exhibiting the effect of greatly decreasing a friction coefficient under low humidity. This is presumed to be because a coating film which is formed of the component (A) and considered to contribute to a decrease in the friction coefficient of a sliding surface is not formed under high humidity or is not maintained even if formed under high humidity. In contrast, the inclusion of a certain amount of branched-chain aliphatic monoamine (component (B1)) together with the component (A) in the lubricating oil composition enables the action of forming a coating film on a sliding surface, exhibited by the component (A), to be prominently promoted or maintained under high humidity although the branched-chain aliphatic monoamine (component (B1)) does not have the action of decreasing a friction coefficient under low humidity, and therefore, the lubricating oil composition A is presumed to exhibit excellent friction characteristics not only under low humidity but also under high humidity.

Since the branched-chain aliphatic monoamine which is the component (B1) has favorable solubility in a lubricant base oil, the lubricating oil composition A can also be expected to be improved with respect to storage stability.

Blending of a certain amount of mixture (component (A)) of the acid phosphate esters having the particular structure and a certain amount of straight-chain aliphatic monoamine (component (B2)) allows the lubricating oil composition B to exhibit excellent friction characteristics even under both low humidity and high humidity. Therefore, the lubricating oil composition B enables the provision of a lubricating oil for a sliding guide surface that can be used without deterioration of friction characteristics not only under low humidity but also under high humidity (for example, in the rainy season, the summer season, or the like).

The mechanism of the action by which the lubricating oil composition B exhibits such an effect is not clear but is presumed as follows. However, the following presumption does not provide a limited interpretation of the effect of the lubricating oil composition B but instead provides an explanation of the effect as an example.

That is to say, the mixture (component (A)) of the monoester and diester of the acid phosphate esters included in the lubricating oil composition B tends to reduce the effect of decreasing a friction coefficient under high humidity while exhibiting the effect of greatly decreasing a friction coefficient under low humidity. This is presumed to be because a coating film which is formed of the component (A) and considered to contribute to a decrease in the friction coefficient of a sliding surface is not formed under high humidity or is not maintained even if formed under high humidity. In contrast, the inclusion of a certain amount of straight-chain aliphatic monoamine (component (B2)) together with the component (A) in the lubricating oil composition enables the action of forming a coating film on a sliding surface, exhibited by the component (A), to be prominently promoted or maintained under high humidity although the straight-chain aliphatic monoamine (component (B2)) does not have the action of decreasing a friction coefficient under low humidity, and therefore, the lubricating oil composition B is presumed to exhibit excellent friction characteristics not only under low humidity but also under high humidity.

Improvement in corrosion resistance can also be expected due to neutralizing the straight-chain aliphatic monoamine which is the component (B2) with the mixture (component (A)) of the monoester and diester of the acid phosphate esters.

<Lubricant Base Oil>

The lubricant base oil used in the lubricating oil composition of the present disclosure is not particularly restricted, and may be a mineral oil-based lubricant base oil or a synthetic oil-based lubricant base oil.

Examples of the mineral oil-based lubricant base oil include a solvent refined mineral oil, a hydrogenation refining mineral oil, a hydrocracked mineral oil, or the like obtained by purifying a lube-oil distillate of crude oil in appropriate combination of solvent refining, hydrogenation refining, and the like. Examples thereof also include a base oil obtained by hydrocracking treatment and hydrogenation isomerization treatment of a raw material such as slack wax obtained by solvent dewaxing.

Examples of the synthetic oil-based lubricant base oil include an α-olefin oligomer which is a polymer of an α-olefin having from 3 to 12 carbon atoms, a sebacate such as 2-ethylhexylsebacate or dioctyl sebacate, a dialkyl diester having from 4 to 12 carbon atoms such as an azelate or an adipate, 1-trimethylolpropane, a polyol such as an ester of a pentaerythritol and a monobasic acid having from 3 to 12 carbon atoms, an alkylbenzene having an alkyl group having from 9 to 40 carbon atoms, a polyglycol such as polyglycol obtained by condensing butyl alcohol with propylene oxide, or a phenyl ether such as a polyphenyl ether having about from 2 to 5 ether linkages and about from 3 to 6 phenyl groups. Additional examples thereof include a base oil obtained by hydrocracking treatment and hydrogenation isomerization treatment of a raw material such as wax obtained by Fischer-Tropsch synthesis.

The mineral oil-based lubricant base oil and the synthetic oil-based lubricant base oil may be used singly, or in mixture of two or more kinds thereof.

The kinematic viscosity of the base oil used in the lubricating oil composition of the present disclosure is not particularly restricted, and the kinematic viscosity at 40° C. is preferably from 10 to 300 $mm^2/s$, more preferably from 20 to 250 $mm^2/s$, and particularly preferably from 30 to 100 $mm^2/s$.

The kinematic viscosity of the base oil herein is a value measured according to "Determination of Kinematic Viscosity" (JIS K 2283: 2000).

<Acid Phosphate Ester Mixture>

The acid phosphate ester mixture (component (A)) having a structure represented by the following Formula (1) and including an acid phosphate monoester and an acid phosphate diester is included in the lubricating oil composition of the present disclosure.

In a case in which the lubricating oil composition of the present disclosure is an aspect of the lubricating oil composition A, the acid phosphate ester mixture which is the component (A) is included in a content of from 0.12 to 0.5% by mass based on a total amount of the composition.

In a case in which the lubricating oil composition of the present disclosure is an aspect of the lubricating oil composition B, the acid phosphate ester mixture which is the component (A) is included in a content of from 0.12 to 0.6% by mass based on a total amount of the composition.

The acid phosphate ester mixture which is the component (A) is a mixture of an acid phosphate monoester in which one of $R^1$ or $R^2$ in the following Formula (1) is a saturated or unsaturated straight-chain aliphatic hydrocarbon group having from 1 to 30 carbon atoms, and the other is a hydrogen atom, and an acid phosphate diester in which both $R^1$ and $R^2$ in the following Formula (1) are saturated or unsaturated straight-chain aliphatic hydrocarbon groups having from 1 to 30 carbon atoms.

$$(R^1O)(R^2O)(HO)P{=}O \quad (1)$$

In Formula (1), each of $R^1$ and $R^2$ represents a hydrogen atom or a saturated or unsaturated straight-chain aliphatic hydrocarbon group having from 1 to 30 carbon atoms, and $R^1$ and $R^2$ are not simultaneously hydrogen atoms.

The number of carbon atoms in the straight-chain aliphatic hydrocarbon group represented by $R^1$ or $R^2$ is from 1 to 30, preferably from 4 to 22, and more preferably from 8 to 18.

The straight-chain aliphatic hydrocarbon group represented by $R^1$ or $R^2$ may be saturated or unsaturated, and is preferably a straight-chain alkyl group having from 1 to 30 carbon atoms or a straight-chain alkenyl group having from 2 to 30 carbon atoms.

Preferred examples of the straight-chain alkyl group represented by $R^1$ or $R^2$ include hexyl group, heptyl group, octyl group, nonyl group, decyl group, undecyl group, dodecyl group, tridecyl group, tetradecyl group, pentadecyl group, hexadecyl group, heptadecyl group, or octadecyl group.

Preferred examples of the straight-chain alkenyl group represented by $R^1$ or $R^2$ include hexenyl group, heptenyl group, octenyl group, nonenyl group, decenyl group, undecenyl group, dodecenyl group, tridecenyl group, tetradecenyl group, pentadecenyl group, hexadecenyl group, heptadecenyl group, octadecenyl group, or oleyl group.

Specific examples of the component (A) include a mixture of a mono- or di-ester of an octyl acid phosphate ester, or a mixture of a mono- or di-ester of an oleyl acid phosphate ester.

A mixture ratio (x/y) between the acid phosphate monoester (x) and the acid phosphate diester (y) in the component (A) is, in a molar ratio, preferably from 10/90 to 90/10, more preferably from 20/80 to 80/20, and still more preferably from 30/70 to 70/30 from the viewpoint of friction characteristic.

The acid phosphate monoester and the acid phosphate diester included in the acid phosphate ester mixture which is the component (A) may be one kind of acid phosphate monoester and one kind of acid phosphate diester, respectively, or may be a combination of plural kinds of acid phosphate monoesters and a combination of plural kinds of acid phosphate diesters, respectively.

The straight-chain aliphatic hydrocarbon group (i.e., $R^1$ or $R^2$) included in the acid phosphate monoester and the two straight-chain aliphatic hydrocarbon groups (i.e., $R^1$ and $R^2$) included in the acid phosphate diester may be the same or different.

The two straight-chain aliphatic hydrocarbon groups present in one molecule of the acid phosphate diester are the same straight-chain aliphatic hydrocarbon groups. That is to say, the acid phosphate ester mixture which is the component (A) can include one or more acid phosphate diesters, and $R^1$ and $R^2$ in one molecule of the acid phosphate diesters are the same straight-chain aliphatic hydrocarbon groups.

The component (A) is preferably a mixture of an acid phosphate monoester and an acid phosphate diester having the same straight-chain aliphatic hydrocarbon groups of which each is the straight-chain aliphatic hydrocarbon group represented by $R^1$ or $R^2$ in Formula (1). The component (A) may be a mixture including one or more combinations of an acid phosphate monoester and an acid phosphate diester having the same straight-chain aliphatic hydrocarbon groups.

Examples of specific aspects of the acid phosphate ester mixture which is the component (A) include the following aspects described in (1) to (3).

(1) An aspect which is a mixture including one kind of an acid phosphate monoester in which $R^1$ is any one straight-chain aliphatic hydrocarbon group selected from a saturated or unsaturated straight-chain aliphatic hydrocarbon group having from 1 to 30 carbon atoms, and $R^2$ is a hydrogen atom, and one kind of an acid phosphate diester including, as $R^1$ and $R^2$, the same straight-chain aliphatic hydrocarbon groups as $R^1$ in the acid phosphate monoester.

Examples of this aspect include a mixture of mono- and di-esters of an octyl acid phosphate ester, and a mixture of mono- and di-esters of an oleyl acid phosphate ester, but are not limited thereto.

(2) An aspect including two or more kinds of mixtures including one kind of an acid phosphate monoester in which $R^1$ is any one straight-chain aliphatic hydrocarbon group selected from a saturated or unsaturated straight-chain aliphatic hydrocarbon group having from 1 to 30 carbon atoms, and $R^2$ is a hydrogen atom, and one kind of an acid phosphate diester including, as $R^1$ and $R^2$, the same straight-chain aliphatic hydrocarbon groups as $R^1$ in the acid phosphate monoester.

Examples of this aspect include a combined aspect of a mixture of mono- and di-esters of an octyl acid phosphate ester, and a mixture of mono- and di-esters of an oleyl acid phosphate ester, but are not limited thereto.

(3) An aspect which is a mixture including one or more kinds of acid phosphate monoesters in which $R^1$ is any one straight-chain aliphatic hydrocarbon group selected from a saturated or unsaturated straight-chain aliphatic hydrocarbon group having from 1 to 30 carbon atoms, and $R^2$ is a hydrogen atom, and one or more kinds of acid phosphate diesters including, as $R^1$ and $R^2$, straight-chain aliphatic hydrocarbon groups different from $R^1$ in the acid phosphate monoester.

Examples of this aspect include a mixture of a monoester of an octyl acid phosphate ester and an oleyl acid phosphate diester, and a mixture of a monoester of an oleyl acid phosphate ester and an octyl acid phosphate diester, but are not limited thereto.

The component (A) is preferably a mixture of an acid phosphate monoester and an acid phosphate diester (the mixture of the aspect (1) or (2) described above) having, as the straight-chain aliphatic hydrocarbon group represented by $R^1$ or $R^2$ in Formula (1), the same straight-chain fat hydrocarbon group.

In a case in which the lubricating oil composition of the present disclosure is the aspect of the lubricating oil composition A, the content of the component (A) in the lubricating oil composition A is from 0.12 to 0.5% by mass with respect to the total amount of the composition, and preferably from 0.15 to 0.35% by mass with respect to the total amount of the composition, from the viewpoint of a friction characteristic and a corrosion prevention property.

In a case in which the lubricating oil composition of the present disclosure is the aspect of the lubricating oil composition B, the content of the component (A) in the lubricating oil composition B is from 0.12 to 0.6% by mass with respect to the total amount of the composition, and preferably from 0.15 to 0.5% by mass with respect to the total amount of the composition, from the viewpoint of a friction characteristic and a corrosion prevention property.

<Branched-Chain Aliphatic Monoamine>

In a case in which the lubricating oil composition of the present disclosure is the aspect of the lubricating oil composition A, the lubricating oil composition A includes a branched-chain aliphatic monoamine (component (B1)) in a content of from 0.015 to 0.09% by mass based on a total amount of the composition.

It is preferable that the branched-chain aliphatic monoamine which is the component (B1) is an aliphatic monoamine in a molecule of which one, two, or three saturated or unsaturated branched chain aliphatic hydrocarbon groups are included, and is an alkylamine represented by the following Formula (2A).

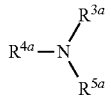

(2A)

In Formula (2A), each of $R^{3a}$, $R^{4a}$, and $R^{ya}$ independently represents a hydrogen atom or a branched-chain alkyl group having from 3 to 22 carbon atoms, and at least one of $R^{3a}$, $R^{4a}$, or $R^{5a}$ is a branched-chain alkyl group having from 3 to 22 carbon atoms.

The number of carbon atoms in the branched-chain alkyl group represented by $R^{3a}$, $R^{4a}$, or $R^{5a}$ is preferably from 4 to 18 from the viewpoint of a friction characteristic. Preferred examples of the branched-chain alkyl group represented by $R^{3a}$, $R^{4a}$, or $R^{5a}$ include isopropyl group, isobutyl group, isopentyl group, isohexyl group, isooctyl group, isononyl group, isodecyl group, isoundecyl group, isododecyl group, isotridecyl group, isotetradecyl group, isopentadecyl group, isohexadecyl group, isoheptadecyl group, or isooctadecyl group.

The component (B1) is preferably an aliphatic monoamine in which each of $R^{3a}$ and $R^{4a}$ is independently a branched-chain alkyl group having from 3 to 22 carbon atoms, and $R^{5a}$ is a hydrogen atom, and is preferably a secondary monoamine in which both $R^{3a}$ and $R^{4a}$ are the same branched-chain alkyl groups selected from a branched-chain alkyl group having from 3 to 22 carbon atoms from the viewpoint of a cost.

Preferred examples of the branched-chain aliphatic monoamine which is the component (B1) include 2-ethylhexylamine and di-2-ethylhexylamine.

The content of the component (B1) in the lubricating oil composition A is from 0.015 to 0.09% by mass based on the total amount of the composition, and preferably from 0.02 to 0.08% by mass based on the total amount of the composition, from the viewpoint of achieving both of a friction characteristic under low humidity and a friction characteristic under high humidity. An excellent friction characteristic under high humidity is obtained in a case in which the content of the component (B1) is 0.015% by mass or more, and the deterioration of a friction characteristic under low humidity is inhibited in a case in which the content of the component (B1) is 0.09% by mass or less.

A molar ratio between the acid phosphate ester mixture (A) and the branched-chain aliphatic monoamine (B1) (acid phosphate ester mixture/branched-chain aliphatic monoamine=A/B1) is preferably from 1.0 to 6.5, and more preferably from 1.2 to 5.2 from the viewpoint of achieving a friction characteristic under low humidity and a friction characteristic under high humidity.

In the lubricating oil composition for a sliding guide surface of the invention, the content ratio (molar ratio) between the acid phosphate ester mixture and the branched-chain aliphatic monoamine is confirmed as follows.

In a case in which the acid phosphate ester mixture is the aspect (1) described above, the mole (A) is calculated by dividing the content of the acid phosphate ester mixture by the average molecular weight of the acid phosphate monoester and the acid phosphate diester included in the mixture.

In a case in which the acid phosphate ester mixture is the aspect (2) described above (i.e., in a case in which two or more kinds of acid phosphate ester mixtures in which $R^1$ and $R^2$ are the same are included), the mole (A) is calculated as the sum of the moles of the acid phosphate ester mixtures.

In a case in which the acid phosphate ester mixture is the aspect (3) described above, the mole (A) is calculated as one of a value obtained by dividing the content of one kind of an acid phosphate monoester included in the mixture by the molecular weight of the corresponding acid phosphate monoester or a value obtained by dividing the content of one kind of an acid phosphate diester included in the mixture by the molecular weight of the corresponding acid phosphate diester, or as the sum of two or more of such values.

The mole (B1) of the branched-chain aliphatic monoamine is calculated by dividing the content of the branched-chain aliphatic monoamine by the molecular weight of the branched-chain aliphatic monoamine. Thus, the molar ratio (A/B1) between the acid phosphate ester mixture and the branched-chain aliphatic monoamine is calculated by dividing the mole (A) of the acid phosphate ester mixture by the mole (B1) of the branched-chain aliphatic monoamine.

In a case in which two or more kinds of branched-chain aliphatic monoamines are included, the mole (B1) is calculated as the sum of the moles of the branched-chain aliphatic monoamines.

<Straight-Chain Aliphatic Monoamine>

In a case in which the lubricating oil composition of the present disclosure is the aspect of the lubricating oil composition A, the lubricating oil composition includes a straight-chain aliphatic monoamine (component (B2)) in a content of from 0.12 to 0.4% by mass based on a total amount of the composition.

It is preferable that the straight-chain aliphatic monoamine which is the component (B2) is an aliphatic monoamine in a molecule of which one, two, or three saturated or unsaturated straight-chain aliphatic hydrocarbon groups are included, and is an alkylamine represented by the following Formula (2B).

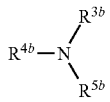

(2B)

In Formula (2B), each of $R^{3b}$, $R^{4b}$, and $R^{5b}$ independently represents a hydrogen atom or a straight-chain alkyl group having from 1 to 22 carbon atoms, and at least one of $R^{3b}$, $R^{4b}$, or $R^{5b}$ is a straight-chain alkyl group having from 1 to 22 carbon atoms.

The number of carbon atoms in the straight-chain alkyl group represented by $R^{3b}$, $R^{4b}$, or $R^{5b}$ is from 4 to 18 from the viewpoint of a friction characteristic. Preferred examples of the straight-chain alkyl group represented by $R^{3b}$, $R^{4b}$, or $R^{5b}$ include propyl group, butyl group, pentyl group, hexyl group, octyl group, nonyl group, decyl group, undecyl group, dodecyl group, tridecyl group, tetradecyl group, pentadecyl group, hexadecyl group, heptadecyl group, or octadecyl group.

The component (B2) is preferably a primary monoamine in which any one of $R^{3b}$, $R^{4b}$, or $R^{5b}$ is a straight-chain alkyl group from the viewpoint of a cost.

Preferred examples of the straight-chain aliphatic monoamine which is the component (B2) include octylamine and oleylamine which are primary monoamines.

Preferred examples of combinations of the component (A) and the component (B2) include a combination of at least one acid phosphate ester mixture selected from a mixture of mono- and di-esters of an octyl acid phosphate ester or a mixture of mono- and di-esters of an oleyl acid phosphate ester, and of at least one straight-chain aliphatic monoamine selected from an octylamine or an oleylamine, from the viewpoint of a friction characteristic.

The content of the component (B2) in the lubricating oil composition B is from 0.12 to 0.4% by mass with respect to the total amount of the composition, and preferably from 0.12 to 0.3% by mass with respect to the total amount of the composition, from the viewpoint of achieving both of a friction characteristic under low humidity and a friction characteristic under high humidity. An excellent friction characteristic under the high humidity can be obtained in a case in which the content of the component (B) is an amount of 0.12% by mass or more, while the deterioration of a friction characteristic under low humidity is inhibited in a case in which the content is 0.4% by mass or less.

<Sulfur Compound>

The lubricating oil composition of the present disclosure may include a sulfur compound (hereinafter may be referred to as "component (C)"). Examples of such a sulfur compound include a hydrocarbon sulfide, and sulfurized oil and fat.

Examples of the hydrocarbon sulfide include a hydrocarbon sulfide represented by the following Formula (3) or Formula (4).

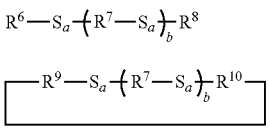

In Formula (3) and Formula (4), each of $R^6$ and $R^8$ independently represents a monovalent hydrocarbon group (for example, a straight-chain or branched-chain, saturated or unsaturated aliphatic hydrocarbon group having from 2 to 20 carbon atoms, such as an alkyl group or an alkenyl group, or an aromatic hydrocarbon group having from 6 to 26 carbon atoms), and each of $R^7$, $R^9$, and $R^{10}$ independently represents a divalent hydrocarbon group (for example, a straight-chain or branched-chain, saturated or unsaturated aliphatic hydrocarbon group having from 2 to 20 carbon atoms, or an aromatic hydrocarbon group having from 6 to 26 carbon atoms).

In Formula (3), one of the monovalent hydrocarbon groups represented by $R^6$ and $R^8$ may be a monovalent hydrocarbon group further having a functional group such as a hydroxy group, a carbonyl group, a carboxyl group, or an ester group.

In Formula (3) and Formula (4), a is an integer 1 or more, each a in a repeating unit may be the same or different, and b represents an integer 0, or 1 or more.

Specific examples of the monovalent hydrocarbon group represented by $R^6$ or $R^8$ include an ethyl group, a propyl group, a butyl group, a nonyl group, a dodecyl group, a propenyl group, a butenyl group, a phenyl group, a tolyl group, a hexylphenyl group, or a benzyl group.

Specific examples of the divalent hydrocarbon group represented by $R^7$, $R^9$, or $R^{10}$ include an ethylene group, a propylene group, a butylene group, and a phenylene group.

Specific examples of the compounds of such hydrocarbon sulfides include (i) a polysulphide compound such as diisobutyl disulfide, dioctyl polysulphide, di-tert-butyl polysulphide, di-tert-nonyl polysulphide, or dibenzyl polysulphide, (ii) a sulfurized olefin obtained by sulfurating an olefin such as polyisobutylene or a terpene with a sulfide such as sulfur, and (iii) a compound that is a reaction product of isobutylene and sulfur and that is presumed to have a structure represented by the following Formula (5) or Formula (6).

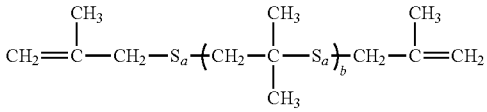

In Formula (5), a and b are the same as a and b in Formula (3).

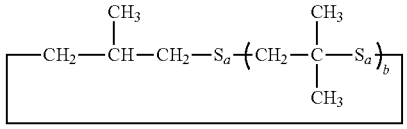

In Formula (6), a and b are the same as a and b in Formula (4).

Examples of the sulfurized oil and fat include a reaction product of oil and fat with sulfur.

Examples of the oil and fat include animal and vegetable oil and fat such as lard, beef tallow, whale oil, palm oil, coconut oil, or rapeseed oil.

The content of the component (C) in the lubricating oil composition for a sliding guide surface of the invention is preferably from 0.1 to 15% by mass, and more preferably from 0.2 to 5% by mass, with respect to the total amount of the composition, from the viewpoint of a friction characteristic.

<Other Additives>

In the lubricating oil composition of the present disclosure, a known lubricating oil additive may be further used singly, or in combination of two or more kinds thereof, for the purpose of further enhancing various performances.

Examples of such additives include: a metal deactivator such as fatty acid, a phenol-based antioxidant, an amine-based antioxidant, or a benzotriazole derivative; a pour-point depressant such as a styrene-butadiene hydrogenated polymer, an ethylene propylene polymer, polyisobutylene, or polymethacrylate; an antifoaming agent such as polyacrylate or dimethylpolysiloxane; a demulsifier such as an ethylene oxide-propylene oxide copolymer; or a rust-preventive agent such as an alkenylsuccinate half-ester.

Examples

Embodiments of the invention will now be specifically described with reference to Examples, and the invention is not restricted at all by the Examples.

As Example or Comparative Example of the lubricating oil composition A, a lubricating oil composition for a sliding guide surface having a composition set forth in Table 1 was prepared. A base oil and an additive used in the preparation are as follows.

Base oil (solvent-refined, paraffin-based mineral oil, kinematic viscosity at 40° C.: 68 $mm^2/s$, viscosity index: 100, flash point: 224° C.)

Component (A) 1 (mixture of octyl acid phosphate monoester and octyl acid phosphate diester, mixture molar ratio (from 60 to 50/from 40 to 50)

Component (A) 2 (mixture of oleyl acid phosphate monoester and oleyl acid phosphate diester, mixture molar ratio (from 60 to 50/from 40 to 50)

Component (B1) B1-1 (2-ethylhexylamine)

Component (B1) B1-2 (di-2-ethylhexylamine)

Component (C) (sulfate ester, included in hydrocarbon sulfide represented by Formula (3) described above)

As Example or Comparative Example of the lubricating oil composition B, a lubricating oil composition for a sliding guide surface having a composition set forth in Table 2 was prepared. A base oil and an additive used in the preparation are as follows.

Base oil (solvent-refined, paraffin-based mineral oil, kinematic viscosity at 40° C.: 68 $mm^2/s$, viscosity index: 100, flash point: 224° C.)

Component (A) 1 (mixture of octyl acid phosphate monoester and octyl acid phosphate diester, mixture molar ratio (from 60 to 50/from 40 to 50)

Component (A) 2 (mixture of oleyl acid phosphate monoester and oleyl acid phosphate diester, mixture molar ratio (from 60 to 50/from 40 to 50)

Component (B2) B2-1 (octylamine)

Component (B2) B2-2 (oleylamine)

Component (C) (sulfate ester, included in hydrocarbon sulfide represented by Formula (3) described above)

Dynamic friction coefficients under high humidity and low humidity were measured by a friction characteristic test described below using a sample for evaluation dispensed from the lubricating oil composition for a sliding guide surface of each of Examples and Comparative Examples, to evaluate friction characteristics. The results are set forth in Table 1 or Table 2.

<Friction Characteristic Test>

FIG. 1 is a schematic view illustrating the configuration of a system for measuring a friction coefficient used in the friction characteristic test. The measurement is controlled and automatically operated by an NC control apparatus 10. Frictional force generated in the measurement test is detected by a lubrication performance evaluation apparatus 20 including a strain gauge and is output to a PC (personal computer) 40 through an A/D conversion machine 30, and the measurement value thereof is recorded in the PC 40.

Figure 2:
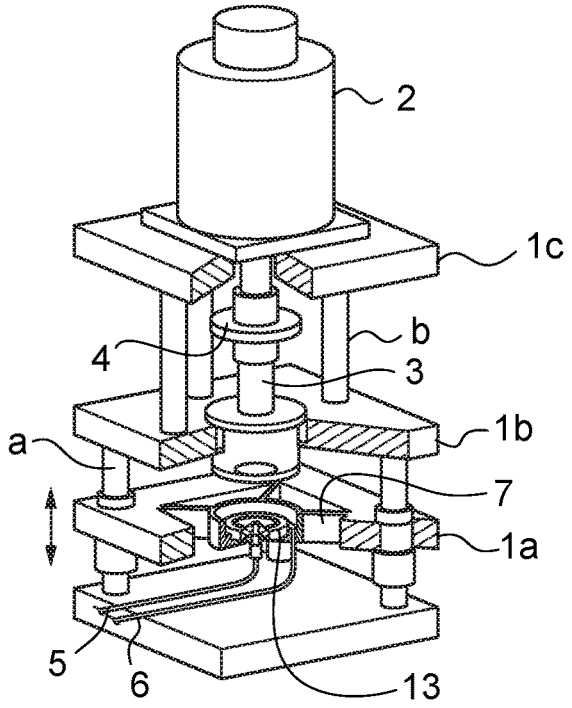
FIG. 2 is a schematic view partly illustrating a cross section of a lubrication performance evaluation apparatus in the machine for testing a friction coefficient used in Examples.

FIG. 2 is a schematic view partly illustrating a cross section of the lubrication performance evaluation apparatus 20 illustrated in FIG. 1.

As illustrated in FIG. 2, the lubrication performance evaluation apparatus 20 includes: a base table (including a movable base 1*a*, stationary bases 1*b* and 1*c*, and struts a and b.); a servomotor 2 fixed to the base table; a shaft 3 including one end to which the rotation of the servomotor 2 is transmitted, and another end to which a rotating body 3*a* that retains an upper test piece A is attached; a coupling 4 attached to the shaft 3; a lower test piece B which is disposed on the movable base 1*a* disposed elevatably with respect to the base table at a position facing a friction surface of the upper test piece A, and a friction surface of which faces the friction surface of the upper test piece A; a feed oil pipe 5 through which a lubricating oil composition (i.e., a sample for evaluation) is supplied between the upper test piece A and the lower test piece B; a drain oil pipe 6 through which the lubricating oil composition is drained; and a dynamometer 7 that detects frictional force generated between the test pieces A and B in a case in which the servomotor 4 is rotated in a state in which the upper test piece A and the lower test piece B are brought into contact with each other.

A structure in which the lubricating oil composition (i.e., a sample for evaluation) is supplied from a lower portion of the lower test piece B by a pump (not illustrated) and sent from the central portion of the test piece to the frictional surface is provided.

The upper test piece A and the lower test piece B rotate while the surfaces of the upper test piece A and the lower test piece B are in flush surface contact with each other, and the generated frictional force is detected as frictional torque by the dynamometer 7 including the strain gauge.

The friction characteristics test was conducted after performing trial runs for 0, 4, 8, and 16 hours using the measurement system illustrated in FIG. 1 at a sliding rate of 0.01 μm/s to 100 mm/s, and a surface pressure of 2.0 $kg/cm^2$. In the test, a temperature was set at 25° C., a humidity in evaluation under low-humidity conditions was regulated to 30% RH or less, and a humidity in evaluation under high-humidity conditions was regulated to 75% RH or more.

The evaluation was performed by measuring the dynamic friction coefficients of each lubricating oil composition of the Examples and Comparative Examples at a sliding rate of 0.01 μm/s, 8 or 16 hours after the trial run.

The dynamic friction coefficients of each lubricating oil composition of the Examples and Comparative Examples, obtained by the machine for measuring and testing a friction coefficient under the test conditions, are set forth in Table 1 or Table 2.

A case in which the dynamic friction coefficients under both the low humidity and the high humidity are from 0.010 to 0.040 is evaluated as being a lubricating oil composition having excellent friction characteristics having no problem in practical use.

TABLE 1

| | | Example Al | Example A2 | Example A3 | Example A4 | Example A5 | Comparative Example Al | Comparative Example A2 | Comparative Example A3 | Comparative Example A4 | Comparative Example A5 | Comparative Example A6 |
|---|---|---|---|---|---|---|---|---|---|---|---|---|
| Composition (% by mass) | Base oil | Balance | Balance | Balance | Balance | Balance | Balance | Balance | Balance | Balance | Balance | Balance |
| | Component (A) 1 | | 0.15 | | 0.15 | | | | | 0.6 | 0.1 | |
| | Component (A) 2 | 0.35 | | 0.2 | 0.15 | 0.24 | 0.2 | 0.15 | 0.15 | | | 0.2 |

TABLE 1-continued

| | Example Al | Example A2 | Example A3 | Example A4 | Example A5 | Comparative Example Al | Comparative Example A2 | Comparative Example A3 | Comparative Example A4 | Comparative Example A5 | Comparative Example A6 |
|---|---|---|---|---|---|---|---|---|---|---|---|
| Component (B1) B1-1 | 0.08 | | | | | | | | | 0.08 | 0.08 |
| Component (B1) B1-2 | | 0.04 | 0.02 | 0.08 | 0.08 | | 0.01 | 0.1 | 0.12 | | |
| Component (C) | 0.5 | 0.5 | 0.5 | 2 | 0.5 | 0.5 | 0.5 | 0.5 | 0.5 | 0.5 | 0.5 |
| Component (A)/component (B1) ratio (molar ratio) | 1.21 | 3.41 | 5.16 | 2.67 | 1.55 | — | 7.74 | 0.77 | 4.55 | 0.61 | 0.69 |
| (1) Friction characteristic (low humidity: 30% RH or less at 25° C.) Dynamic friction coefficient | 0.028 | 0.024 | 0.019 | 0.026 | 0.025 | 0.016 | 0.016 | 0.043 | 0.052 | 0.120 | 0.086 |
| (2) Friction characteristic (high humidity: 75% RH or more at 25° C.) Dynamic friction coefficient | 0.038 | 0.033 | 0.030 | 0.039 | 0.036 | 0.076 | 0.061 | 0.048 | 0.070 | 0.128 | 0.116 |

The evaluation results set forth in Table 1 reveal the following.

Each lubricating oil composition of Examples A1 to A5, including a lubricant base oil as well as an acid phosphate ester mixture which is a component (A) and a branched-chain aliphatic monoamine which is a component (B1) at certain contents (% by mass) and a certain molar ratio (hereinafter referred to as an A/B1 ratio), has excellent friction characteristics under low humidity and high humidity and is found to be optimum as a lubricating oil for a sliding guide surface that is hardly affected by a change in the humidity of a working environment.

In contrast, Comparative Example A1, which does not contain a branched-chain aliphatic monoamine which is a component (B1), is found to result in a poor friction characteristic under high humidity.

Comparative Example 2 in which the content of the branched-chain aliphatic monoamine which is a component (B1) is less than 0.015% by mass, which is the lower limit value in the lubricating oil composition A, and the A/B1 ratio is more than 6.5 is found to result in a poor friction characteristic under high humidity.

Comparative Example 3 in which the content of the branched-chain aliphatic monoamine which is a component (B1) is slightly more than 0.09% by mass, which is the upper limit value in the lubricating oil composition A, and the A/B1 ratio is less than 1.0 is found to result in poor friction characteristics under low humidity and high humidity.

Comparative Example 4 in which both the contents of the acid phosphate ester mixture which is a component (A) and the branched-chain aliphatic monoamine which is a component (B1) are more than the upper limit value in the lubricating oil composition A is found to result in poor friction characteristics under low humidity and high humidity.

Comparative Example 5 in which the content of the acid phosphate ester mixture which is a component (A) is less than 0.12% by mass, which is the lower limit value in the lubricating oil composition A, and the A/B1 ratio is less than 1.0 is found to result in poor friction characteristics under both low humidity and high humidity.

Comparative Example 6 in which only the A/B1 ratio is less than 1.0 and out of the range of the lubricating oil composition A is found to result in poor friction characteristics under both low humidity and high humidity.

As described above, Examples A1 to A5 and Comparative Examples A1 to A5 reveal that it is necessary to blend the component (A) and the component (B1) at appropriate contents (% by mass) and an appropriate molar ratio from the viewpoint of achieving both friction characteristics under low humidity and high humidity.

TABLE 2

| | | Example B1 | Example B2 | Example B3 | Example B4 | Example B5 | Comparative Example B1 | Comparative Example B2 | Comparative Example B3 | Comparative Example B4 | Comparative Example B5 |
|---|---|---|---|---|---|---|---|---|---|---|---|
| Composition | Base oil | Balance | Balance | Balance | Balance | Balance | Balance | Balance | Balance | Balance | Balance |
| (% by mass) | Component (A) 1 | 0.15 | 0.2 | 0.3 | 0.3 | 0.2 | | | 0.3 | | |
| | Component (A) 2 | | 0.15 | | 0.2 | 0.15 | 0.2 | 0.2 | | 0.7 | 0.1 |
| | Component (B2) B2-1 | | | 0.12 | 0.1 | | | | | 0.4 | |

TABLE 2-continued

| | Example B1 | Example B2 | Example B3 | Example B4 | Example B5 | Comparative Example B1 | Comparative Example B2 | Comparative Example B3 | Comparative Example B4 | Comparative Example B5 |
|---|---|---|---|---|---|---|---|---|---|---|
| Component (B2) B2-2 | 0.12 | 0.3 | | 0.1 | 0.2 | | 0.1 | 0.5 | | 0.12 |
| Component (C) | 0.5 | 0.5 | 0.5 | 0.5 | 2 | 0.5 | 0.5 | 0.5 | 0.5 | |
| (1) Friction characteristic (low humidity: 30% RH or less at 25° C.) Dynamic friction coefficient | 0.018 | 0.017 | 0.019 | 0.020 | 0.023 | 0.016 | 0.040 | 0.040 | 0.072 | 0.097 |
| (2) Friction characteristic (high humidity: 75% RH or more at 25° C.) Dynamic friction coefficient | 0.024 | 0.027 | 0.026 | 0.022 | 0.027 | 0.056 | 0.051 | 0.090 | 0.107 | 0.147 |

The evaluation results set forth in Table 2 reveal the following.

Each lubricating oil composition of Examples B1 to B5, including a lubricant base oil as well as an acid phosphate ester mixture which is a component (A) and a straight-chain aliphatic monoamine which is a component (B2) at certain contents (% by mass), has excellent friction characteristics under low humidity and high humidity and is found to be optimum as a lubricating oil for a sliding guide surface that is hardly affected by a change in the humidity of a working environment.

In contrast, Comparative Example B1, which does not contain a straight-chain aliphatic monoamine which is a component (B2), is found to result in a poor friction characteristic under high humidity.

Comparative Example B2 in which the content of the straight-chain aliphatic monoamine which is a component (B2) is less than 0.12% by mass, which is the lower limit value in the lubricating oil composition B, is found to result in a poor friction characteristic under high humidity.

Comparative Example B3 in which the content of the straight-chain aliphatic monoamine which is a component (B2) is more than 0.4% by mass, which is the upper limit value in the lubricating oil composition B, is found to result in a poor friction characteristic under high humidity.

Comparative Example B4 in which the content of the acid phosphate ester mixture which is a component (A) is 0.7% by mass, which is more than the upper limit value in the lubricating oil composition B, is found to result in poor friction characteristics under both low humidity and high humidity.

Comparative Example B5 in which the content of the acid phosphate ester mixture which is a component (A) is less than 0.12% by mass, which is the lower limit value in the lubricating oil composition B, is found to result in poor friction characteristics under both low humidity and high humidity.

As described above, Examples B1 to B5 and Comparative Examples B1 to B5 reveal that it is necessary to blend the component (A) and the component (B2) at appropriate contents (% by mass) from the viewpoint of achieving both friction characteristics under low humidity and high humidity.

The entire disclosures of Japanese Patent Application No. 2016-189965 filed on Sep. 28, 2016, and Japanese Patent Application No. 2016-221262 filed on Nov. 14, 2016 are incorporated herein by reference.

All documents, patent applications, and technical standards described in this specification are herein incorporated by reference to the same extent as if each individual document, patent application, or technical standard was specifically and individually indicated to be incorporated by reference.

The invention claimed is:

1. A lubricating oil composition for a sliding guide surface, comprising:

a lubricant base oil;

an acid phosphate ester mixture having a structure represented by the following Formula (1) and comprising an acid phosphate monoester and an acid phosphate diester; and an aliphatic monoamine, the lubricating oil composition satisfying the following condition A:

condition A: a content of the acid phosphate ester mixture is from 0.15 to 0.35% by mass based on a total amount of the composition, the aliphatic monoamine is a branched-chain aliphatic monoamine, a content of the branched-chain aliphatic monoamine is from 0.02 to 0.08% by mass based on the total amount of the composition, and a molar ratio (A/B) between the acid phosphate ester mixture (A) and the branched-chain aliphatic monoamine (B) in the composition is from 1.21 to 5.16, $$(R^1O)(R^2O)(HO)P{=}O \quad (1)$$

wherein, in Formula (1), each of $R^1$ and $R^2$ represents a hydrogen atom or a saturated or unsaturated straight-chain aliphatic hydrocarbon group having from 1 to 30 carbon atoms, and $R^1$ and $R^2$ are not simultaneously hydrogen atoms.

2. The lubricating oil composition for a sliding guide surface according to claim 1, further comprising from 0.1 to 15% by mass of a sulfur compound based on the total amount of the composition.

3. The lubricating oil composition for a sliding guide surface according to claim 1, wherein dynamic friction coefficients respectively measured at 25° C. 75% RH and 25° C. 30% RH are both within a range of 0.010 to 0.040.

* * * * *